US007874364B2

(12) United States Patent
Redlinger et al.

(10) Patent No.: US 7,874,364 B2
(45) Date of Patent: Jan. 25, 2011

(54) METHOD FOR JARRING WITH A DOWNHOLE PULLING TOOL

(75) Inventors: Thomas M. Redlinger, Houston, TX (US); Christopher M. Vreeland, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 427 days.

(21) Appl. No.: 12/023,864

(22) Filed: Jan. 31, 2008

(65) Prior Publication Data

US 2009/0194285 A1 Aug. 6, 2009

(51) Int. Cl.
*E21B 31/107* (2006.01)

(52) U.S. Cl. ..... 166/301; 166/178; 175/296

(58) Field of Classification Search ..... 166/301, 166/178; 175/296, 297; 173/177, 204
See application file for complete search history.

(56) References Cited

U.S. PATENT DOCUMENTS

| | | | |
|---|---|---|---|
| 2,377,249 | A | 5/1945 | Lawrence |
| 2,537,413 | A | 1/1951 | Lawrence |
| 3,539,025 | A | 11/1970 | Sutliff et al. |
| 4,258,792 | A | 3/1981 | Restarick |
| 5,040,598 | A | 8/1991 | Pleasants |
| 5,070,941 | A | 12/1991 | Kilgore |
| 5,361,834 | A | 11/1994 | Cox |
| 5,673,754 | A | 10/1997 | Taylor, Jr. |
| 6,164,393 | A | 12/2000 | Bakke |
| 6,202,767 | B1 | 3/2001 | Friis |
| 6,328,101 | B1 | 12/2001 | Friis |
| 7,066,263 | B1 | 6/2006 | Mouton |
| 7,077,205 | B2 | 7/2006 | Eddison |
| 7,165,612 | B2 | 1/2007 | McLaughlin |
| 2004/0251027 | A1 | 12/2004 | Sonnier et al. |

OTHER PUBLICATIONS

Canadian Office Action for Application No. 2,650,364 dated Jun. 29, 2010.

*Primary Examiner*—Daniel P Stephenson
(74) *Attorney, Agent, or Firm*—Patterson & Sheridan, L.L.P.

(57) ABSTRACT

The present invention generally relates to an apparatus and method of jarring with an overpull generator. In one aspect, a method of dislodging an object stuck in a wellbore is provided. The method includes the step of running an assembly into the wellbore on a conveyance member and attaching the assembly to the object, wherein the assembly comprises an overpull generator and a delay force release device. The method also includes the step of generating an overpull force in the wellbore by selectively activating the overpull generator. Additionally, the method includes the step of applying an impact force to the object by activating the delay force release device and releasing the generated overpull force, thereby dislodging the object stuck in the wellbore. In a further aspect, an assembly for dislodging an object stuck in a wellbore is provided. In yet a further aspect, an overpull generator for use in generating an overpull force in a wellbore is provided.

33 Claims, 4 Drawing Sheets

100

METHOD FOR JARRING WITH A DOWNHOLE PULLING TOOL

BACKGROUND OF THE INVENTION

1. Field of the Invention

Embodiments of the present invention generally relate to an apparatus and methods for generating a downhole overpull force. More specifically, the present invention relates to jarring with a downhole overpull generator.

2. Description of the Related Art

In a conventional downhole fishing operation, a bottom hole assembly is lowered into a wellbore on a drill string. The bottom hole assembly typically includes a slinger, a jar, and a fishing tool (such as an overshot) that are connected via drill collars and drill pipe. A jar is a device that is used downhole to deliver an impact load to another downhole component, especially when that object is stuck in the wellbore. The jar generally includes a device for storing energy (e.g. a spring or a pressure chamber) and a triggering device that is configured to activate the jar at a predetermined instant, thereby allowing the jar to deliver the impact load.

During the fishing operation, the bottom hole assembly is lowered into the wellbore and attached to the object stuck in the wellbore by utilizing the fishing tool. Thereafter, a rig at the surface of the wellbore is used to pull up on the drill string, imparting a force on the drill string and storing the created energy in the slinger and the drill string. At a predetermined pull force and/or time, the triggering device in the jar activates the jar, thereby causing the jar to deliver the impact load to the object stuck in the wellbore.

The use of a bottom hole assembly in a conventional fishing operation may be effective in dislodging an object stuck in a vertical wellbore since the rig is able to pull up on the drill string and generate the energy for use with the jar. However, a problem arises when the same bottom hole assembly is used in a deviated wellbore. In this situation, the rig is not fully pulling up on the drill string and generating the energy for use with the jar due to the curvature and the associated friction between the drill string and the wall of the wellbore.

Therefore, there is a need for a device and a method of generating a overpull force downhole. There is a further need for a device and a method of fishing with a downhole overpull generator.

SUMMARY OF THE INVENTION

The present invention generally relates to an apparatus and method of fishing with an overpull generator. In one aspect, a method of impacting an object in a wellbore is provided. The method includes the step of running an assembly into the wellbore on a conveyance member and attaching the assembly to the object, wherein the assembly comprises an overpull generator and a delay force release device. The method also includes the step of generating an overpull force in the wellbore by selectively activating the overpull generator. Additionally, the method includes the step of applying an impact force to the object by activating the delay force release device and releasing the generated overpull force, thereby dislodging the object stuck in the wellbore.

In another aspect, a method of freeing an object stuck in a wellbore is provided. The method includes the steps of generating an overpull force downhole and storing the overpull force downhole. The method also includes the step of selectively releasing the overpull force in the wellbore and applying a force to the object to free the stuck object.

In a further aspect, an assembly for dislodging an object stuck in a wellbore is provided. The assembly includes an overpull generator configured to generate an overpull force in the wellbore. The assembly also includes a delay force release device configured to selectively release the overpull force and apply an impact force. Additionally, the assembly includes a coupling member configured to attach to the object stuck in the wellbore.

In yet a further aspect, an overpull generator for use in generating an overpull force in a wellbore is provided. The overpull generator includes a housing having a section configured to transmit torque. The overpull generator further includes a series of fluid actuated pistons disposed in the housing. The overpull generator also includes a piston rod movable in the housing between a first position and a second position by utilizing the series of fluid actuated pistons, the piston rod having a section configured to transmit torque.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an apparatus and method of jarring with an overpull generator. More specifically, the invention relates to a bottom hole assembly that includes an overpull generator that works in conjunction with a delay force release device to dislodge an object stuck in the wellbore. It is to be noted, however, that even though the overpull generator will be described in relation to the delay force release device, the present invention is not limited to a delay force release device, but is equally applicable to other types of downhole tools. Additionally, the present invention will be described as it relates to a deviated wellbore. However, it should be understood that the present invention may be employed in a vertical or a non-deviated wellbore without departing from the principles of the present invention. To better understand the novelty of the apparatus of the present invention and the methods of use thereof, reference is hereafter made to the accompanying drawings.

Figure 1:
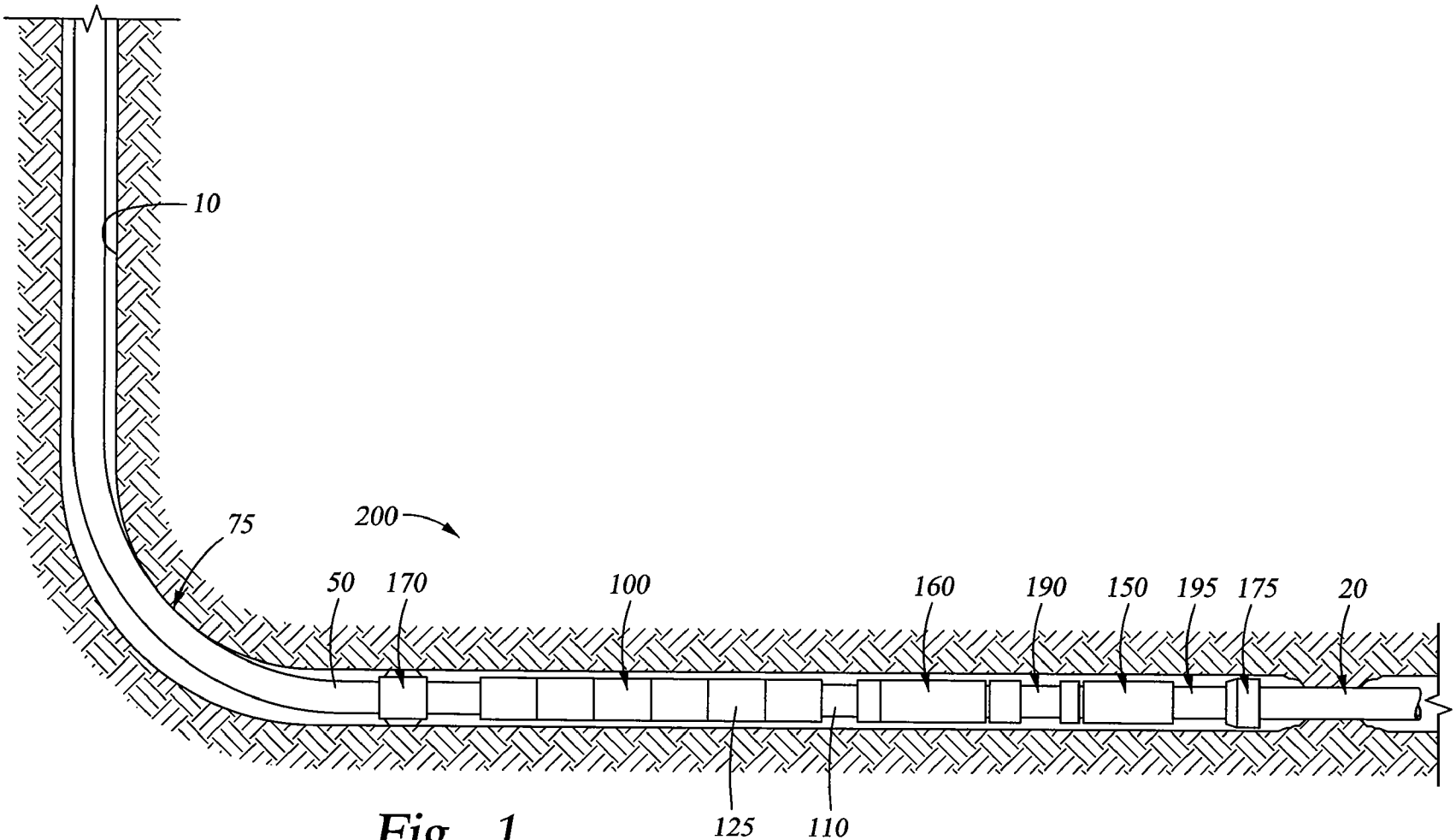
FIG. 1 is a view illustrating a bottom hole assembly disposed in a wellbore with a piston rod in an overpull generator in an extended position.

FIG. 1 is a view illustrating a bottom hole assembly 200 disposed in a wellbore 10 with an overpull generator 100 in an extended position. The bottom hole assembly 200 is generally used to dislodge an object 20 that is stuck in the wellbore 10. As will be described herein, the bottom hole assembly 200 includes the overpull generator 100 configured to apply a force, a slinger 160 configured to store the energy, a delay force release device 150 configured to release the stored energy, and a coupling member 175 configured to grip the object 20. The bottom hole assembly 200 may also include an optional anchor device 170 that is configured to secure the bottom hole assembly 200 in the wellbore 10.

It should be noted that the overpull generator 100 is positioned in the bottom hole assembly 200 proximate the delay force release device 150. This arrangement minimizes pulling force loss due to wellbore friction relative to the conventional fishing operation. In other words, in the conventional fishing operation, the drill string is pulled at the surface to create an overpull, however, this arrangement results in a relatively lower tension at the bottom hole assembly due to an interface 75 with the wellbore 10. Furthermore, due to wellbore friction at the interface 75, it may be hard to determine how much force is actually experienced at the bottom hole assembly in the conventional fishing operation which may reduce the effectiveness of the operation. Additionally, there is typically a limit to how much tension can be applied by some rigs/hoists, and a limit to the tensile rating of the drill string (or another type of conveyance member). However, by using the overpull generator 100 in the wellbore 10, the overpull generator 100 enables these limitations to be circumvented by ensuring the necessary load is applied directly to the bottom assembly 200. Additionally, not only is it possible to generate a higher load, but a known load can be applied based upon the known piston characteristics of the overpull generator 100. Further, when the overpull generator 100 is used in combination with downhole instrumentation and optional data communication (e.g. wires, EM, mud pulse), the operational characteristics can be determined and then tailored to suit the situation in the wellbore 10.

Figure 2:
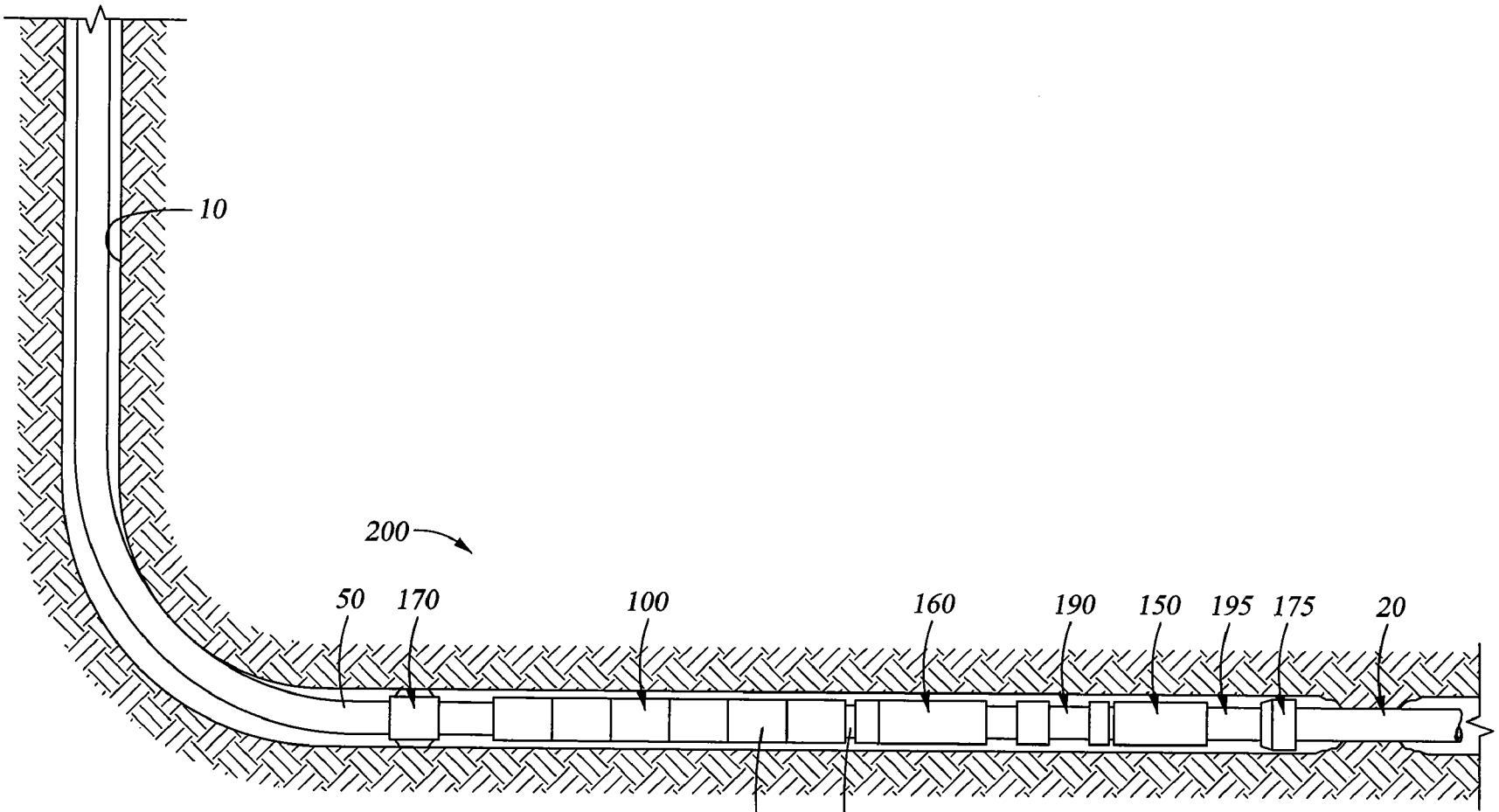
FIG. 2 is a view illustrating the bottom hole assembly disposed in the wellbore with the piston rod in the overpull generator in a retracted position.
Figures 3, 5:
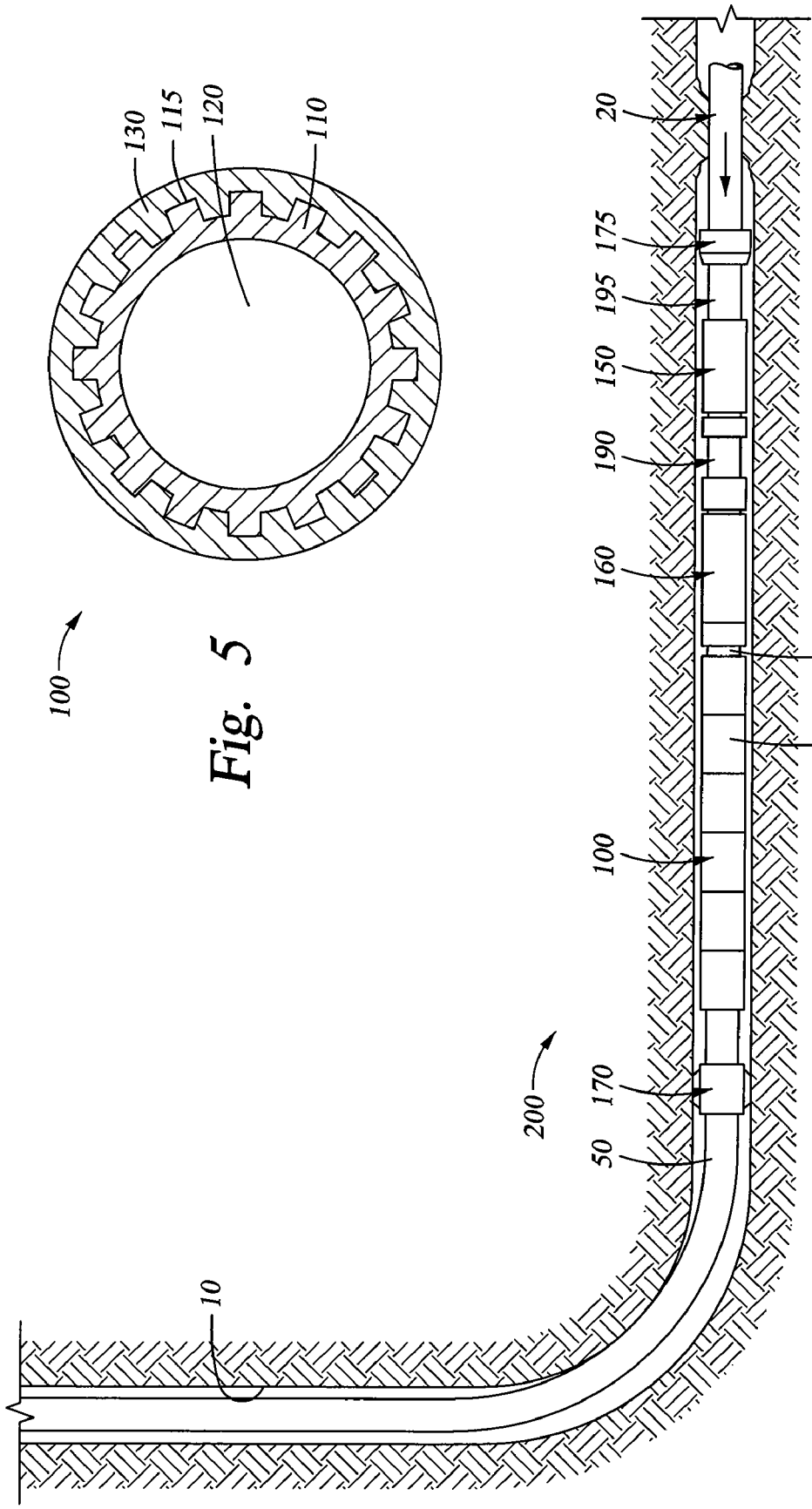
FIG. 3 is a view illustrating the bottom hole assembly disposed in the wellbore after an object in the wellbore has been dislodged.
FIG. 5 is a cross-sectional view taken along line 5-5 in FIG. 4.

The overpull generator 100 is configured to create a force which is used by the other components in the bottom hole assembly 200 to dislodge the object 20. The energy is generated by moving a piston rod 110 of the overpull generator 100 between an extended position and a retracted position, as shown in FIGS. 1-3. Although the bottom hole assembly 200 in FIGS. 1-3 shows the overpull generator 100 in a downward position, the overpull generator 100 may be in an upward position, thereby reversing the direction of the actuation force and the release force without departing from principles of the present invention. Generally, the overpull generator 100 includes a plurality of pistons 125 that activate due to a pressure drop in the bottom hole assembly 200. The overpull generator 100 will be described in greater detail in FIGS. 3 and 4.

The slinger 160 is configured to store energy that is generated by the overpull generator 100. Generally, the slinger 160 is a tool that is used in conjunction with the delay force release device 150 to store energy that comes from the overpull generator 100. An example of a slinger is set forth in U.S. Pat. No. 6,328,101, which is herein incorporated by reference in its entirety. The energy, once released by the slinger 160, provides an impact force that operates associated downhole tools to help the release of the object 20 stuck in the wellbore 10. The energy may be stored in the slinger 160 by any means known in the art, such as by a mechanical spring or a compressible fluid.

The delay force release device 150 is generally a device that releases energy after a certain period of time. The delay force release device 150 may be any type of device known in the art that is configured to release energy, such as a jar. An example of a jar is set forth in U.S. Pat. No. 6,202,767, which is herein incorporated by reference in its entirety. As known in the art, a jar is a device that is used downhole to deliver an impact load to another downhole component, especially when that component is stuck. The delay force release device 150 may be hydraulically activated by using a timer comprising a viscous flow meter, whereby at a predetermined over pull force generated by the overpull generator 100 a detent releases thereby allowing the delay force release device 150 to release. Alternatively, the delay force release device 150 may be mechanically activated by using a mechanical timer, whereby at a predetermined overpull force generated by the overpull generator 100 the mechanical timer allows the delay force release device 150 to release. Even though the respective designs may be different, each device uses energy that is stored in the slinger 160 and is suddenly released by the delay force release device 150 when it fires.

The delay force release device 150 can be designed to strike up, down, or both. In the case of jarring up above the stuck object 20, as shown in FIG. 1, the slinger 160 and a plurality of drill collars 190, 195 are pulled upward by the overpull generator 100 but the stuck object does not move. Since the slinger 160 and the drill collars 190, 195 are moving up, this means that the slinger 160 and the drill collars 190, 195 are stretching and storing energy. When the delay force release device 150 reaches a predetermined overpull force, the delay force release device 150 suddenly allows one section of the delay force release device 150 to move axially relative to a second section, being pulled up rapidly in much the same way that one end of a stretched spring moves when released. After a few inches of movement, this moving section slams into a steel shoulder in the delay force release device 150, imparting an impact load on the stuck object 20.

The coupling means 175 is a tool that is capable of connecting to the object 20 in the wellbore 10, such as an overshot. The coupling means 175 may be configured to engage on the outside surface of the object 20 stuck in the wellbore 10. Typically, the coupling device 175 includes a grapple or similar slip mechanism that grips the object 20 such that a force and jarring action may be applied to the object 20. If the object 20 cannot be removed, a release system within the coupling device 175 allows the coupling means 175 to be disengaged and retrieved.

The bottom hole assembly 200 optionally may include the anchor device 170. The anchor device 170 may be positioned in the bottom hole assembly 200 above the overpull generator 100. The anchor device 170 may include a slip mechanism that is configured to grip the walls of the wellbore 10 in order to secure the bottom hole assembly 200 in the wellbore 10. In another embodiment, the anchor device may be part of the overpull generator 100.

The bottom hole assembly 200 optionally may also include a vibration member (not shown). An example of a vibration member is set forth in U.S. Pat. No. 6,164,393, which is herein incorporated by reference in its entirety. The vibration member is used to generate vibration that works in conjunction with the impact force of the delay force release device 150 to dislodge the object 20 stuck in the wellbore 10. The vibration member may generate the vibration by any suitable means known in the art, such as oscillating a moving mass, creating a cyclic restriction to fluid flowing through the bottom hole assembly 200, an electromagnetic oscillator, creating pressure pulses in a fluid, or injecting gas, a liquid, or a combination thereof into fluid operatively associated with the device in the bottom hole assembly 200.

The bottom hole assembly 200 may include a hydraulic or mechanical disconnect device (not shown) to allow the operator to disconnect from the object 20 and retry the downhole operation. An example of a disconnect device is described in U.S. patent application Ser. No. 11/842,837, which is herein incorporated by reference in its entirety. The use of the disconnect device allows the operator to disconnect and reconnect to the object 20 multiple times.

The bottom hole assembly 200 may include a sensing member (not shown) that is configured to measure a downhole parameter. In one embodiment, the sensing member may be configured to measure the impact force applied by the delay force release device 150 to the object 20. In a further embodiment, the sensing member may be configured to measure the amount of force (i.e. energy) generated by the overpull generator 100. In another embodiment, the sensing member may be configured to measure a torque, a direction of rotation and a rate of rotation of a component in the bottom hole assembly 200. The sensing member may send the measured data to the surface via a communication line in the conveyance member 50. Alternatively, the sensing member may send the measured data to a memory device in the bottom hole assembly 200 which is capable of storing the measured data until the data is retrieved when the bottom hole assembly 200 is removed from the wellbore 10. Further, the sensing member may send the measured data to the surface via EM or mud pulse devices. The measured data may be used by an operator to effectively perform the downhole operation. For instance, the operator may use the data to tailor the downhole operation (or subsequent attempts) to dislodge the object 20 stuck in the wellbore 10.

The bottom hole assembly 200 is disposed in the wellbore 10 on a conveyance member 50. The conveyance member 50 may be any type of member that is capable of positioning the bottom hole assembly 200 in the wellbore 10, such as a drill string, coiled tubing, Corod®, etc.

In operation, the bottom hole assembly 200 is positioned in the wellbore 10 to allow the coupling member 175 to attach to the stuck object 20. Thereafter, the conveyance member 50 is pulled upward to remove any slack that may be in the in the conveyance member 50. Next, the piston rod 110 is moved to the extended position by further pulling up on the conveyance member 50. Alternatively, the bottom hole assembly 200 may be lowered into the wellbore 10 with the piston rod 110 in the extended position. In either case, the overpull generator 100 is in the extended position in order to generate the energy to be used by the delay force release device 150. Subsequently, fluid is pumped down the conveyance member 50 into the overpull generator 100 to create a pressure differential which causes the pistons 125 in the overpull generator 100 to retract the piston rod 110. The movement of the piston rod 110 from the extended position to the retracted position generates an overpull force (i.e. energy) that is stored in the slinger 160 and will be used to dislodge the object 20 stuck in the wellbore 10. At a predetermined overpull force, the delay force release device 150 fires thereby releasing the energy stored in the slinger 160 and imparting an impact load on the stuck object 20. The impact load may be 3 to 5 times the initial overpull force. Further, if the anchor member 170 is part of the bottom hole assembly 200, then the anchor device 170 is set prior to the movement of the piston rod 110 from the extended position to the retracted position in order to support the overpull force generated by the overpull generator 100. Additionally, if there is a vibrator in the bottom hole assembly 200, then the vibrator may be activated when the fluid is pumped down the conveyance member 50 to create the pressure differential that activates the overpull generator 100.

The movement of the piston rod 110 of the overpull generator 100 from the extended position to the retracted position generates an overpull force (i.e. energy) that will be used to dislodge the object 20 stuck in the wellbore 10. The overpull generator 100 is activated by a pressure differential between the inside the overpull generator 100 and the outside the overpull generator 100. The pressure differential causes the plurality of pistons 125 in the overpull generator 100 to retract the piston rod 110. The pressure differential may be generated by regulating the flow rate through the overpull generator 100 or by using a restriction in the overpull generator 100. If the pressure drop across the overpull generator 100 is not sufficient with the existing bottom hole assembly 200, then an orifice sub (not shown) may be included in the bottom hole assembly 200, and positioned below the overpull generator 100 in order to create the pressure differential required to activate the overpull generator 100 and move the piston rod 110 from the extended position to the retracted position. In one embodiment, the overpull generator 100 is activated at a predetermined threshold pressure differential. In this embodiment, the overpull generator 100 may include a frangible member (not shown), such as a shear screw, between components of the overpull generator 100, wherein the frangible member is configured to shear (or break apart) at a predetermined pressure differential thereby allowing the pistons 125 to retract the piston rod 110. Alternatively, the overpull generator 100 may include a biasing member (not shown), such as a spring, that is configured to bias the rod 110, wherein at a predetermined pressure differential the biasing force of the biasing member is overcome thereby allowing the pistons 125 to retract the piston rod 110. Further, the overpull generator 100 may include a combination of frangible members and biasing members.

Although the bottom hole assembly 200 in FIGS. 1 and 2 illustrate a single overpull generator 100 attached to the delay force release device 150, it should be understood, however, that any number of overpull generators 100 may be employed in the bottom hole assembly 200, without departing from principles of the present invention. The use of more than one overpull generator 100 with the delay force release device 150 may be beneficial if there is a need for additional energy to activate the delay force release device 150 or if there is a need for additional stroke in the assembly 200. In another embodiment, a first overpull generator 100 may be positioned in the bottom hole assembly 200 to activate the delay force release device 150 and a second overpull generator 150 may be positioned in the bottom hole assembly 200 between the delay force release device 150 and the coupling device 175 to push against the object 20 to create a push/pull effect. In a further embodiment, the bottom hole assembly 200 may include multiple delay force release devices 150 working in conjunction with multiple overpull generators 100. In the embodiments with multiple overpull generators 100, each overpull generator 100 may have a separate orifice sub to active the overpull generator 100 or a single orifice sub may be moved through the bottom hole assembly 200 to selectively activate each overpull generator 100 at a specified time. In a further embodiment, the overpull generator 100 may be configured to be electrically activated. In this embodiment, the piston rod 110 is movable between the extended position and the retracted position due to an electrical signal. The electrical signal may be communicated from the surface via the conveyance member 50, such as wireline, wired drill pipe, wired coiled tubing, wired Corod®, or wireline run with the drill string.

FIG. 3 is a view illustrating the bottom hole assembly disposed in the wellbore after the object 20 in the wellbore 10 has been dislodged. As illustrated, the piston rod 110 of the overpull generator 100 is in the retracted position and the slinger 160 is deactivated. After the object 20 has been dislodged, the bottom hole assembly 200 may be used to remove the object 20 from the wellbore 10.

Figure 4:
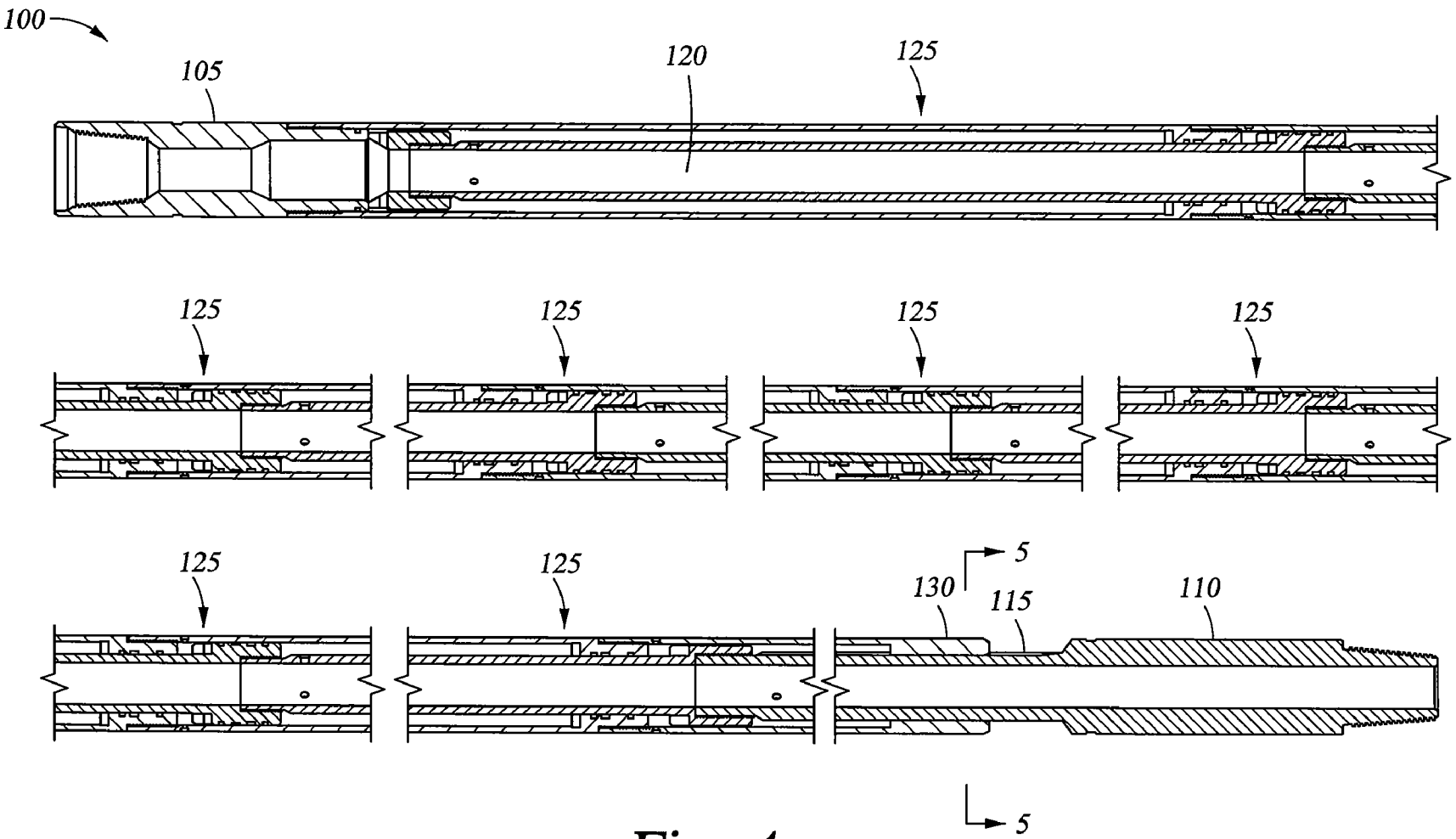
FIG. 4 is a sectional view of the overpull generator.

FIG. 4 is a cross-sectional view of the overpull generator 100. Generally, the overpull generator 100 converts wellbore fluid energy into mechanical energy. As illustrated, the overpull generator 100 includes a top sub 105, the plurality of pistons 125 connected in series, and the piston rod 110. For clarity purposes, the overpull generator 100 is shown in FIG. 4 with the piston rod 110 in a retracted position. As discussed herein, the piston rod 110 of the overpull generator 100 is movable between the extended position and the retracted position to generate the overpull force (i.e. energy) that is used by the other components in the bottom hole assembly 200. As also discussed herein, the pistons 125 cause the piston rod 110 of the overpull generator 100 to move from the extended position to the retracted position. The pistons 125 are operated by a pressure differential that is created between the outside and the inside of the overpull generator 100. If the pressure drop across the overpull generator 100 proximate the bottom sub 110 is not sufficient, then the orifice sub (not shown) may be lowered into the bottom hole assembly. The orifice sub may be positioned below the overpull generator 100 in order to create the pressure differential required to activate the overpull generator 100 and move the piston rod 110 from the extended position to the retracted position. It should be noted that the orifice sub may function as an actuation switch, whereby the overpull generator 100 is selectively activated at a predetermined time.

As illustrated in FIG. 4, the overpull generator 100 includes a bore 120 formed therein. The bore 120 has an enlarged inner diameter. The bore 120 is used to pump fluid through the overpull generator 100. Additionally, the bore 120 may be used to run downhole tools, such as wireline tools, a plasma cutting torch, logging tools such as a freepoint indicator, backoff explosives, a camera, or a string shot, through the overpull generator 100 to perform other downhole wellbore operations. Additionally, darts or balls could be pumped through the bore 120 of the overpull generator 100 to activate a tool below the overpull generator 100.

FIG. 5 is a cross-sectional view taken along line 5-5 in FIG. 4. The overpull generator 100 may also be configured to transmit torque through the overpull generator 100. As shown in FIG. 5, a spline arrangement 115 is formed between the piston rod 110 and a housing 130. A rotational force (i.e. torque) that is generated above the overpull generator 100 may be transferred through the overpull generator 100 via the spline arrangement 115 to a point below the overpull generator 100. The transfer of the rotational force may be useful in dislodging the object stuck in the wellbore or for performing another downhole operation. It should be noted that the overpull generator 100 may transmit the rotational force when the piston rod 110 is in the extended position and the retracted position. In another embodiment, a hexed arrangement, a keyed arrangement or any other torque transmitting arrangement may be formed between the piston rod 110 and the housing 130 that is configured to transmit torque through the overpull generator 100.

As described herein, the overpull generator 100 and the delay force release device 150 has been used in a bottom hole assembly 200 that is configured to dislodge a previously stuck object in the wellbore 10. In another embodiment, the overpull generator 100 and the delay force release device 150 may be part of a drill string assembly (not shown) having a drill bit at a lower end thereof. In this embodiment, if the drill bit becomes stuck during the drilling operation, then the overpull generator 100 may be activated by creating a pressure differential in the drill string assembly. In similar manner as described herein, the overpull generator 100 generates an overpull force that is used by the delay force release device 150 to dislodge the stuck drill bit. In a further embodiment, the overpull generator 100 may be used with the drill bit without the delay force release device 150.

While the foregoing is directed to embodiments of the present invention, other and further embodiments of the invention may be devised without departing from the basic scope thereof, and the scope thereof is determined by the claims that follow.

The invention claimed is:

1. A method of impacting an object in a wellbore, the method comprising:

running an assembly into the wellbore on a conveyance member and attaching the assembly to the object, wherein the assembly comprises an overpull generator and a delay force release device;

generating an overpull force in the wellbore by selectively activating the overpull generator; and applying an impact force to the object by activating the delay force release device and releasing the generated overpull force.

2. The method of claim 1, further comprising creating a back pressure to activate the overpull generator by pumping fluid through the assembly.

3. The method of claim 2, wherein the back pressure is created by a restriction in the overpull generator.

4. The method of claim 2, wherein the back pressure is created by lowering an orifice sub into the assembly to a point below the overpull generator.

5. The method of claim 1, further comprising pumping a ball through a bore of the overpull generator to activate a tool in the assembly.

6. The method of claim 1, further comprising storing the generated overpull force in the assembly until the delay force release device releases the generated overpull force.

7. The method of claim 6, wherein the assembly includes a slinger that is configured to store the overpull force.

8. The method of claim 1, wherein the overpull generator includes a piston rod that is movable between an extended position and a retracted position.

9. The method of claim 8, further comprising pulling on the conveyance member to move the piston rod from the retracted position to the extended position.

10. The method of claim 9, further comprising moving the piston rod from the extended position to the retracted position to generate the overpull force.

11. The method of claim 1, further comprising transmitting a torque through the overpull generator.

12. The method of claim 1, further comprising lowering a tool through a bore of the overpull generator to perform a wellbore operation.

13. The method of claim 1, wherein the delay force release device is hydraulically controlled.

14. The method of claim 1, wherein the conveyance member is coiled tubing.

15. The method of claim 1, wherein the conveyance member is wireline.

16. The method of claim 1, wherein the overpull force generated by the overpull generator is supported by a downhole anchor.

17. A method of freeing an object stuck in a wellbore, the method comprising:

generating an overpull force downhole by using at least two overpull generators positioned in the wellbore;

storing the overpull force downhole; and selectively releasing the overpull force in the wellbore and applying an impact force to the object.

18. The method of claim 17, wherein each overpull generator includes a piston rod having a predetermined stroke.

19. An assembly for dislodging an object stuck in a wellbore, the assembly comprising:

an overpull generator configured to generate an overpull force in the wellbore;

a delay force release device configured to selectively release the overpull force and apply an impact force to the object; and a coupling member configured to attach to the object stuck in the wellbore.

20. The assembly of claim 19, wherein the overpull generator comprising a series of fluid actuated pistons and a piston rod.

21. The assembly of claim 20, wherein the fluid actuated pistons move a piston rod from a first position to a second position to generate the overpull force.

22. The assembly of claim 19, wherein the overpull generator includes a spline assembly configured to transmit a torque through the overpull generator.

23. An overpull generator for use in generating an overpull force in a wellbore, the overpull generator comprising:

a housing having a section configured to transmit torque;

a series of fluid actuated pistons disposed in the housing; and a piston rod movable in the housing between a first position and a second position by utilizing the series of fluid actuated pistons, the piston rod having a section configured to transmit torque.

24. The overpull generator of claim 23, wherein the movement of the piston rod from the first position to the second position generates the overpull force.

25. The overpull generator of claim 23, wherein the section in the housing and the section in the piston rod are configured to mate and form a spline assembly that is capable of transmitting torque through the overpull generator.

26. The overpull generator of claim 23, wherein the section in the housing and the section in the piston rod are configured to mate and form a hexed assembly that is capable of transmitting torque through the overpull generator.

27. The overpull generator of claim 23, further comprising a bore formed in the housing configured to allow a tool to pass through the overpull generator.

28. A method of creating an impact force on an object in a wellbore, the method comprising:

running an assembly into the wellbore on a conveyance member and attaching the assembly to the object;

generating an overpull force, wherein a first portion of the overpull force is generated downhole and a second portion of the overpull force is generated at the surface of the wellbore by pulling on the conveyance member; and applying the impact force to the object by releasing the generated overpull force.

29. The method of claim 28, wherein the first portion of the overpull force is generated by activating a downhole tool.

30. The method of claim 28, further comprising measuring data in the wellbore and communicating the data to an operator.

31. The method of claim 30, further comprising generating a second overpull force and applying a second impact force to the object in response to the measured data.

32. A method of freeing an object stuck in a wellbore, the method comprising:

generating an overpull force downhole by moving a piston rod in an overpull generator from a first position to a second position;

storing the overpull force downhole;

selectively releasing the overpull force in the wellbore and applying an impact force to the object; and transmitting a torque through the overpull generator.

33. A method of freeing an object stuck in a wellbore, the method comprising:

generating an overpull force downhole by moving a piston rod in a housing of an overpull generator between a first position and a second position by utilizing at least one fluid actuated piston, wherein the piston rod includes a section configured to transmit torque;

storing the overpull force downhole;

selectively releasing the overpull force in the wellbore to apply an impact force; and transmitting a torque to the object.

* * * * *